US006047510A

United States Patent [19]

Gallaway

[11] Patent Number: 6,047,510

[45] Date of Patent: Apr. 11, 2000

[54] LOAD-BEARING STRUCTURAL PANEL AND STUCCO SUBSTRATE, AND BUILDING WALL CONTAINING THE SAME

[76] Inventor: James Frank Gallaway, 28970 Camino Alcala, Menifee, Calif. 92584

[21] Appl. No.: 08/948,112

[22] Filed: Oct. 9, 1997

[51] Int. Cl.[7] ..... E04B 2/00

[52] U.S. Cl. ..... 52/347; 52/352; 52/354; 52/579; 52/581; 52/588.1; 52/670; 52/672; 52/405.1

[58] Field of Search ..... 52/352, 354, 356, 52/344, 347, 579, 581, 588.1, 670, 672, 405.1, 405.2, 309.14

[56] References Cited

U.S. PATENT DOCUMENTS

| | | | |
|---|---|---|---|
| 982,291 | 1/1911 | Myers | 52/581 X |
| 1,146,999 | 7/1915 | Burk . | |
| 1,164,160 | 12/1915 | Arey | 52/581 |
| 1,299,425 | 4/1919 | Carpenter | 52/672 X |
| 1,679,914 | 8/1928 | Murray | 52/352 X |
| 1,701,303 | 2/1929 | Jones | 52/352 |
| 1,701,304 | 2/1929 | Jones | 52/352 |
| 1,852,002 | 4/1932 | Clark | 52/352 X |
| 1,877,898 | 9/1932 | Kotrbaty | 52/352 X |
| 2,017,973 | 10/1935 | Jenkins | 52/352 X |
| 2,050,609 | 8/1936 | Howell | 52/352 |
| 2,256,394 | 9/1941 | Lamel | 52/352 X |
| 2,281,371 | 4/1942 | Mugler | 52/347 |
| 3,395,506 | 8/1968 | Petrig . | |
| 3,568,388 | 3/1971 | Flachbarth et al. | 52/588.1 |
| 3,629,046 | 12/1971 | Gilbert | 428/71 |
| 3,867,800 | 2/1975 | Elliott | 52/347 |
| 3,872,636 | 3/1975 | Nicosia . | |
| 4,346,541 | 8/1982 | Schmitt | 52/309.11 |
| 4,475,327 | 10/1984 | O'Regan et al. | 52/579 X |
| 4,571,914 | 2/1986 | Stoyanoff | 52/748.11 |
| 4,734,337 | 3/1988 | Patton . | |
| 5,081,814 | 1/1992 | Singletary et al. . | |
| 5,979,136 | 11/1999 | Marschak | 52/588.1 |

FOREIGN PATENT DOCUMENTS

| | | | |
|---|---|---|---|
| 2113268 | 8/1983 | United Kingdom | 52/404 |

OTHER PUBLICATIONS

Pamphlet Entitled "Rusco", 12 pages, by Rusco Building Systems.

*Primary Examiner*—Laura A. Callo
*Attorney, Agent, or Firm*—Christopher Darrow

[57] ABSTRACT

A load bearing-metal panel and stucco substrate cooperates with adjacent panels to form load bearing studs that are interconnected by a metal lath stucco substrate to which stucco can be applied, each panel being generally in the form of a channel in which insulation can be placed, whereby a wall structure can be formed by adjacent placement and interconnection of panels.

30 Claims, 3 Drawing Sheets

LOAD-BEARING STRUCTURAL PANEL AND STUCCO SUBSTRATE, AND BUILDING WALL CONTAINING THE SAME

BACKGROUND OF THE INVENTION

For many years it has been realized by various persons that walls and studs made primarily of wood have serious drawbacks. One reason for this is the high cost of lumber. Other reasons include labor costs, lack of resistance to termites, etc. Despite the need for moving away from wooden studs and associated building components, a satisfactory building system, that is non-wooden, has not been achieved in conventional housing.

To be satisfactory, it is necessary that the building system include components that can be readily handled by one worker. It is necessary that the system be such that workers—who are normally accustomed to wooden walls—can adapt to it with ease. And, it is highly necessary that the components of the system be manufacturable at low cost but with high strength and high quality. It is necessary that the contractor on the job be able to obtain a reasonable profit margin while still delivering to the home owner a very well-built wall and house.

SUMMARY OF THE INVENTION

In accordance with the present invention, a highly elongate load-bearing metal panel and stucco substrate is provided, and is such that one worker can readily handle it while erecting a wall in a house. By "highly elongate" is meant that the panel has a length at least several times its width, and is sufficiently long to extend at least the great majority of the distance between the floor and ceiling of a conventional dwelling house. Stated more definitely, the panel is typically about 16 inches wide, and about 7 or 8 feet long.

Each panel has at opposite edges thereof elements that nest with corresponding elements of other panels to form strong load-bearing studs that are integral with the panels. ("Integral" is hereby defined to mean formed from the same piece of sheet metal.) Stated otherwise, the edge portions of adjacent panels overlap and lock with each other and combine to form a load-bearing stud. Accordingly, there is such a stud at both edges of each panel.

The stucco substrate is an integral part of each panel, being formed by slitting a sheet metal web and then expanding it to form the substrate. The hole size of the substrate is conventional for stucco, namely about ½ inch. The substrate may be referred to herein as metal lath for stucco, or as metal lath substrate.

The stucco substrate, that is to say the metal lath, extends the great majority of the distance between the stud portions of each panel. Such distance is typically about 14 inches.

The stud portions of the panels are generally channel shaped, each being adapted to nest and interlock with the stud portion of an adjacent panel.

Insulation is provided in each panel and forms a component thereof. The foam is preferably sandwiched between layers of material, one layer being adjacent the stud portion and the other layer being spaced a short distance from the metal lath. The layers confine the foam while it is foamed in place after manufacture of the metal elements or portions of the panels. Spacing of one layer from the metal lath permits the stucco to penetrate through the lath and achieve a "key" shape such that the stucco may not pull away from the lath.

The panels are pre-manufactured at the factory and then shipped to the house site. A base element is mounted on the (typically) concrete slab floor of the house under construction. A first pre-manufactured panel is stood up with its lower end in the base, and then held in place as by a brace. Then, a second pre-manufactured panel is stood up adjacent the first one in such manner that the channel-shaped adjacent stud portions of the two panels nest and interlock. Such nested stud portions are secured together by screws. This procedure is continued for (typically) about 10 feet, following which a cap element is placed over the upper ends of the interlocked panels. Thereafter, at a suitable stage in the building process, stucco is applied to the exteriors of the panels, and wall board (plaster board or dry wall) is secured by screws to the studs on the interiors of the panels.

DETAILED DESCRIPTION OF THE PREFERRED EMBODIMENT

Figure 1:
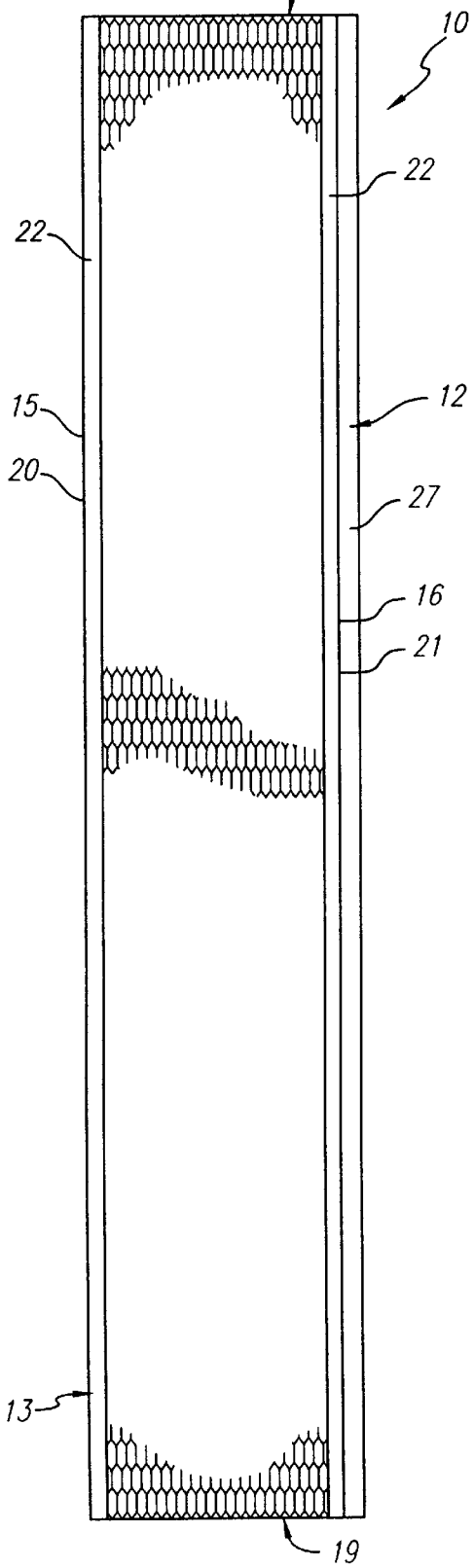
FIG. 1 is a front elevational view of one load-bearing structural panel and substrate incorporating the present invention.
Figure 2:
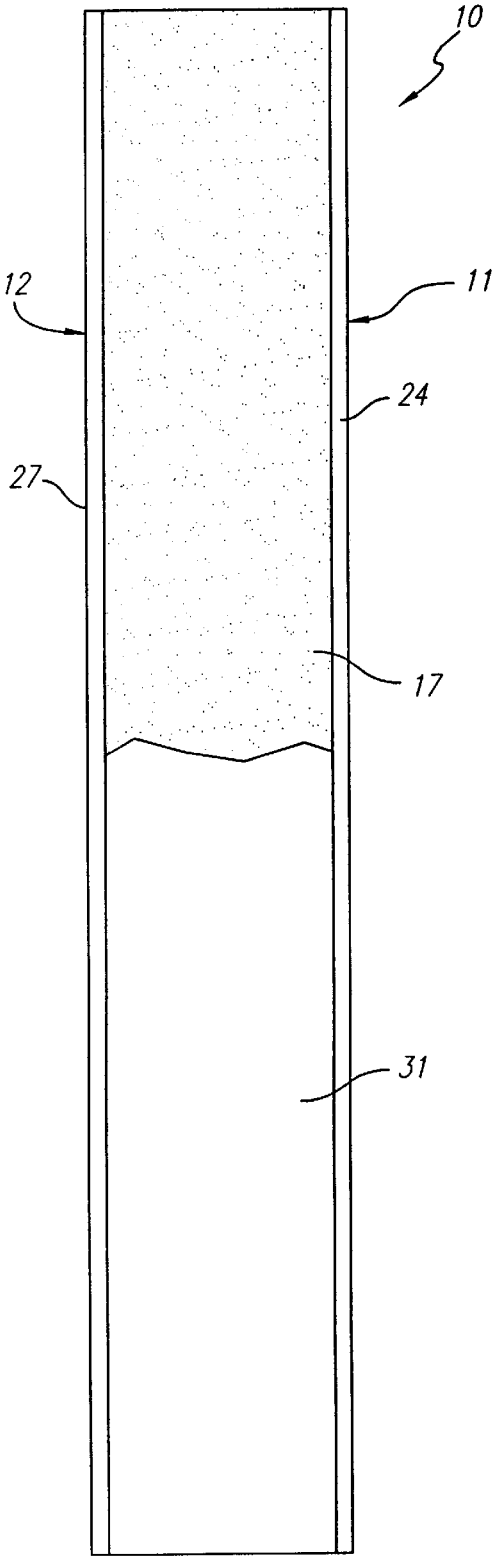
FIG. 2 is a rear elevational view thereof.
Figure 3:
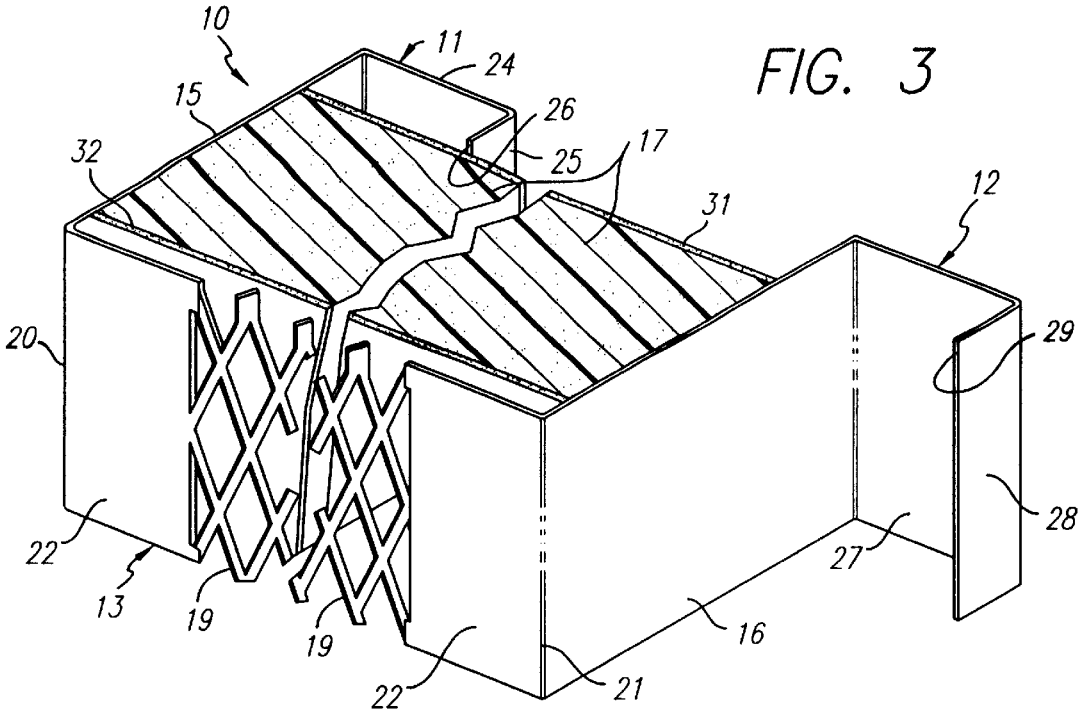
FIG. 3 is an isometric view at the upper end of the panel as the panel is shown in FIG. 1, and looking downwardly.

Referring to FIGS. 1–3, there is shown at 10 a single highly elongate load-bearing metal panel and stucco substrate embodying the present invention. As above indicated, such panel 10 is at least several times as long (vertical) as it is wide (horizontal). Stated more specifically, it is at least about five times as long as it is wide. Preferably, the width of the panel is about 16 inches while the length is about 7–8 feet.

Each panel 10 has stud portions 11,12 at the edges thereof, and has a web 13, the great majority of which is expanded metal, such web extending almost the entire distance between the stud portions. The expanded metal web 13 is so constructed as to be a proper substrate (metal lath) for stucco.

Stud portions 11,12 connect to opposite edges of web 13 by flanges 15,16 that are perpendicular to the web. Thus, the panel 10 is channel-shaped in section, with flange 15 connecting the web to stud portion 11, and with flange 16 connecting the web to stud portion 12. Foam insulation, indicated at 17, is provided in the channel-shaped panel 10 as described below.

Each panel 10 is roll formed of light gauge galvanized sheet steel. The width of the panel at this time is on the order of 17 inches. Then, the web portion of the panel is slit with slits that are sized and located such that upon expansion of the web there will be formed the stucco substrate (metal lath). The hole size is about ½ inch. Then, the webs are expanded to form the lath having the desired proper hole size for stucco.

Preferably, the web is not entirely expanded metal. Instead, there is an expanded metal center portion 19 that extends almost the entire distance between the two corners 20,21 where the web meets flanges 15,16. Solid strips of the sheet steel remain immediately adjacent the corners 20,21 between such corners and the expanded metal 19. These strips 22 are preferably narrow, such as about 1 inch. In the preferred embodiment the distance between corners 20,21 of each panel is 16 inches.

Referring next to stud portion 11, this has a web 24 that is parallel to web 13 and extends toward flange 16. At the inner edge of web 24 is a flange 25 that extends toward web 13 and is parallel to flange 15; it terminates at an edge 26 that is spaced a sufficient distance from web 24 that flange 25 cooperates effectively with the opposed portion of flange 15 (and other portions) to create the desired structural strength.

The stud portion 12 is adapted to fit over stud portion 11 in nesting relationship. Stud portion 12 has a web 27 that is parallel to web 13 but extends outwardly, in a direction away from stud portion 11. At the outer edge of web 27 is a flange 28 that terminates in an edge 29. Edge 29 is disposed approximately the same distance from web 27 that edge 26 is spaced from web 24.

Referring next to the insulating foam 17, such insulating foam 17 is foamed in place at the manufacturing site, after the web 13 has been slit and expanded. This may be done, for example, by providing two parallel walls 31,32 of corrugated cardboard. Wall 31 is disposed inwardly adjacent flange edge 26 and held in place by it as well as by movable support means (not shown). Wall 32 is disposed inwardly adjacent but spaced slightly from web 13, being held by support means (not shown) that extend through the openings in web 13. The cardboard remains in place and is part of each panel 10.

It is pointed out that the described panel may be made much longer than is stated above and employed for one, two or more stories of a dwelling or a commercial building, in the latter case extending from story to story to provide a fast but effective construction operation.

Figure 4:
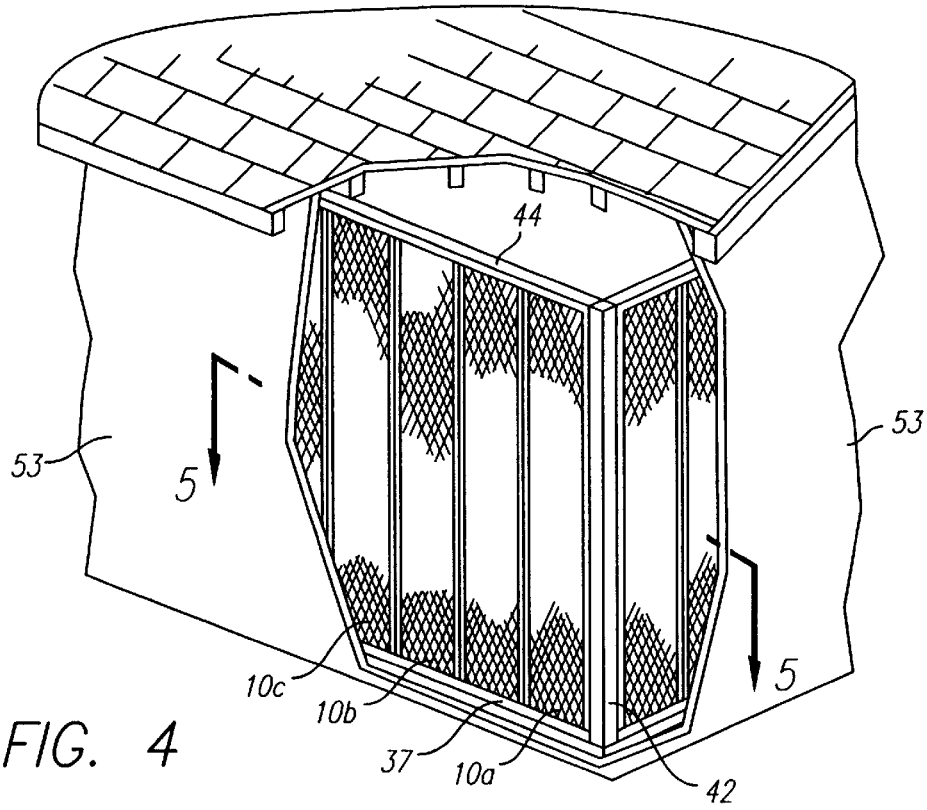
FIG. 4 is an isometric view of a portion of a house incorporating a wall constructed of the present panels, the corner of the house being broken away in order to show the panels in assembled condition.
Figure 5:
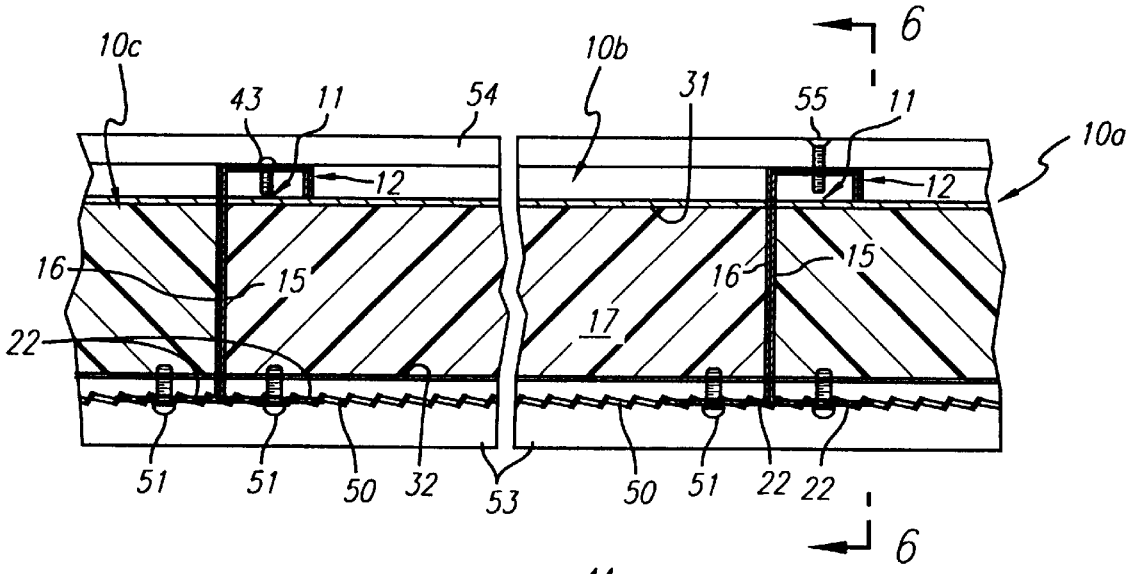
FIG. 5 is a horizontal sectional view on line 5—5 of FIG. 4.
Figure 6:
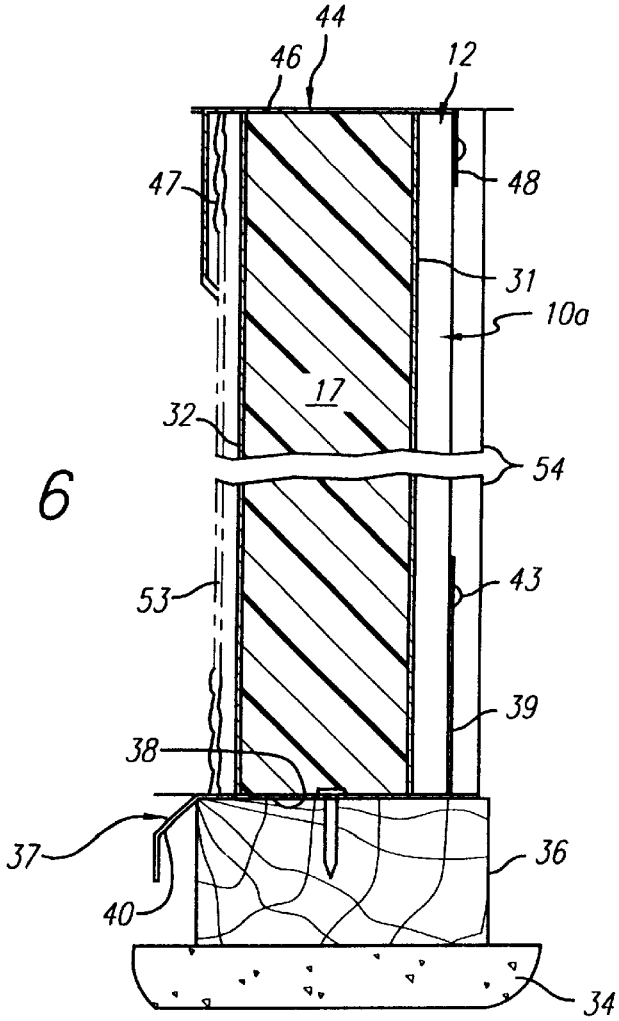
FIG. 6 is vertical sectional view on line 6—6 of FIG. 5.

Description of the Building Wall (and Associated Buildinq Components) Incorporating the Present Invention and Employing the Described Load-Bearing Metal Panel Referring next to FIGS. 4–6 in particular, there is shown a corner portion of a house containing walls and panels constructed in accordance with the present invention. Such house has a subfloor, for example the concrete slab indicated at 34 in FIG. 6. A wooden runner 36 is secured horizontally to slab 34 (FIG. 6) and a sheet metal bottom track 37 is mounted over the runner. (Alternatively, no runner 36 is used; the metal track is attached directly to the slab or to second-story floor.) Bottom track 37 has a web portion 38 that is nailed to the upper surface of runner 36 parallel thereto and seated thereon. It also has a vertical interior portion 39 that is bent upwardly from the inner edge of the web. At the outer edge of web 38 is a downwardly and outwardly extending exterior portion 40.

The worker typically begins at an extreme corner, where there is provided a corner post 42 (FIG. 4) formed of wood. (Alternatively, a break-formed metal panel—having a right-angle bend—is employed as a corner post.) The first of many of the load-bearing metal panels, all identical to the one described in detail above relative to FIGS. 1–3, is then disposed in erect relationship adjacent the corner post 42. The lower end of the panel, which is indicted at 10*a,* is seated on web portion 38 of bottom track 37. Panel 10*a* is then screwed or otherwise secured to corner post 42. A second panel, shown at 10*b,* is then erected adjacent panel 10*a,* with the stud portion 12 of panel 10*b* nested loosely over the stud portion 11 of panel 10*a*. A plurality of self-tapping screws 43 (FIG. 5) are extended in vertically-spaced relationship (one at top, and one at bottom) through the webs 24,25 of both stud portions 11,12.

It is emphasized that the nested and interlocked stud portions 11 and 12, and which are screwed to each other by screws 43, cooperate with the closely adjacent flanges 15,16 (of panels 10*a* and 10*b*) to provide load-bearing studs. Stated otherwise, all of the elements 11,12,15,16, and 43 cooperate with each other to form strong studs that achieve the necessary structural support.

As the next step, panel 10*c* is erected adjacent panel 10*b* and secured thereto by interlocking of stud portions and by vertically-spaced screws 43 (FIG. 5). Alternatively, screws 43 may be omitted. This procedure is repeated for (typically) about 10 feet of panels, namely about seven panels, following which a top track 44 is mounted over all of the erected panels. As best shown in FIG. 6, top track 44 has a horizontal web portion 46 that seats over the panel ends. It also has flanges 47,48 that extend downwardly from web 46 adjacent the fronts and backs of the panels. The top track 44 is secured to the stud portions 11,12 by self-tapping screws.

The described procedure is repeated around all of the exterior walls of the building. At the various corners, corner posts 42 may be employed and/or the present structural panel may be bent at a right angle to form a corner through the expanded metal web 19.

As the next steps, small sections 50 of metal lath are secured by screws 51 over the exteriors of the edge portions of the panels, as shown in FIG. 5. This covers the solid strips 22 and the small cracks between the adjacent panels. Other sections of metal lath (not shown) may be provided over track portions 40 and 47. There are many possible joint details to cover the interlocking portion of the panels.

Stucco 53 (FIG. 5) is then applied to the substrate (metal lath) at the exterior of the house, as best shown in FIG. 5. The stucco passes in part through the openings in the expanded metal 19, and goes into the small space between the metal web and the cardboard 32 (without necessarily filling such space). This creates a "key" action by which the stucco hangs tightly onto the metal lath in very secure relationship.

Conventional-sized sheets of wallboard 54 (plaster board or dry wall) are secured by screws 55 to the stud portions 12. Here it is emphasized that these are conventional full-size drywall sheets (or in some cases support for plaster) and that they are vertically oriented.

The house is finished in the conventional manner by structural elements including trusses over the described walls, and further including the roof (FIG. 4) and various other conventional elements.

In summary, therefore, the present wall formed from the described panels rapidly provides a strong and inexpensive construction having a high degree of thermal insulation capability, and that has the various features outlined above (as well as other).

The foregoing detailed description is to be clearly understood as given by way of illustration and example only, the spirit and scope of this invention being limited solely by the appended claims.

What is claimed is:

1. An elongate load-bearing metal panel and stucco substrate for use in the erection of buildings, said panel and stucco substrate comprising in combination:

(a) a highly elongate channel formed of sheet metal, said channel having a web and having first and second flanges on opposite edges of said web, said web comprising a metal lath stucco substrate;

(b) a first stud portion formed integrally with the edge of said first flange that is remote from said web, said first stud portion extending from said edge generally toward said second flange; and (c) a second stud portion formed integrally with the edge of said second flange that is remote from said web, said second stud portion extending from said edge of said second flange in a direction generally away from said first flange and then turning and extending back toward the web at least a distance sufficient to confine the first stud portion of an adjacent load-bearing panel and stucco substrate of identical cross-sectional shape received therein in nesting configuration, said first stud portion being configured to connect with the second stud portion of an adjacent load-bearing metal panel and stucco substrate in nesting fashion, thereby limiting relative movement between said first and second stud portions in directions parallel to the web and orthogonal to the first and second flanges, and, said second stud portion being configured to connect with the first stud portion of an adjacent metal panel and stucco substrate in nesting fashion, thereby limiting relative movement between said first and second stud portions in directions parallel to the web and orthogonal to the first and second flanges, said first and second stud portions, and said first and second flanges to which said stud portions respectively connect, and the regions of said web near said flanges, being configured to cooperate to form a strong load-bearing stud at the location of interconnection of adjacent panels, said panel and stucco substrate being configured so that it is adapted to interconnect with a plurality of load-bearing panel and stucco substrates of substantially identical cross-sectional shape such that said stud comprises one stud of a continuous wall structure formed by such interconnection comprising a multiplicity of load-bearing studs displaying a wall framing configuration of regularly spaced studs as used in a majority of residential and commercial construction on the interior of the wall structure, said continuous wall structure comprising studs interconnected by metal lath stucco substrate, formed as adjacent load-bearing metal panels and stucco substrates are connected in nesting fashion at the respective stud portions with said first and second flanges adjacent each other.

2. The invention as claimed in claim 1, in which said metal lath stucco substrate is not present in the web portions closely adjacent said flanges, so that the web metal adjacent said flanges is solid and strong to aid in achievement of high strength studs.

3. The invention as claimed in claim 1, in which said load-bearing metal panel and stucco substrate further comprises thermal insulation disposed in said channel.

4. The invention as claimed in claim 3, in which said insulation is synthetic foam that is foamed in place.

5. The invention as claimed in claim 4, in which rigid sheets are provided in said channel to confine said foam while it is foamed in place.

6. The invention as claimed in claim 5, in which said rigid sheets are corrugated cardboard, said cardboard remaining in place in said channel after manufacture of the panel.

7. The invention as claimed in claim 3, in which said first and second stud portions are each channel shaped, in which said first stud portion is adapted to nest in the second stud portion of an adjacent load-bearing metal panel and stucco substrate of substantially identical cross-sectional shape, and in which said second stud portion is adapted to nest over said first stud portion of an adjacent load-bearing metal panel and stucco substrate of substantially identical cross-sectional shape.

8. The invention as claimed in claim 7, in which said load-bearing metal panel and stucco substrate is at least five times as long as it is wide.

9. The invention as claimed in claim 1, in which said metal lath stucco substrate is formed by slitting the web and expanding it, the first and second flanges being integral with the metal lath stucco substrate, and the panel and stucco substrate being formed of a single unitary piece of sheet metal.

10. The invention as claimed in claim 1, in which said first and second stud portions are each channel shaped, in which said first stud portion is adapted to snugly nest in the second stud portion of an adjacent load-bearing metal panel and stucco substrate of substantially identical cross-sectional shape, and in which said second stud portion is adapted to snugly nest over said first stud portion of an adjacent load-bearing metal panel and stucco substrate of substantially identical cross-sectional shape.

11. The invention as claimed in claim 1, in which said load-bearing metal panel and stucco substrate is at least several times as long as it is wide.

12. The invention as claimed in claim 11, in which said load-bearing metal panel and stucco substrate is at least five times as long as it is wide.

13. The invention as claimed in claim 1, in which the distance between the first and second stud portions of said load-bearing metal panel and stucco substrate is about 16 inches center-to-center.

14. The invention as claimed in claim 1, in which said load-bearing metal panel and stucco substrate is formed of light gauge sheet metal.

15. The invention as claimed in claim 14, in which said load-bearing metal panel and stucco substrate, when measured from the outside of the first flange to the outside of the second flange is about 16 inches wide.

16. A house wall comprising:

(a) a multiplicity of adjacent elongate load-bearing metal panels, each of which is also a stucco substrate, said panels-substrates being vertically oriented in a common vertical plane, and being connected to each other in edge-to-edge relationship, said panels-substrates each comprising:

a highly elongate channel formed of sheet metal, said channel having a web and having first and second flanges on opposite edges of said web, said web being slit and expanded to form a metal lath stucco substrate said web and flanges being integral with each other in that they are formed from the same piece of sheet metal, a first stud portion formed integrally with the edge of said first flange that is remote from said web, said first stud portion extending from said edge generally toward said second flange, a second stud portion formed integrally with the edge of said second flange that is remote from said web, said second stud portion extending from said last-mentioned edge in a direction generally away from said first flange and then turning back toward the web and extending a distance sufficient to form an interlock with the first stud portion of an adjacent panel, said first stud portion connecting with the second stud portion of an adjacent said load-bearing metal panel and stucco substrate in nesting fashion, said second stud portion connecting with the first stud portion of an adjacent said metal panel and stucco substrate in nesting fashion, said first and second stud portions, and said first and second flanges to which said stud portions respectively connect, and the regions of said web near said flanges, cooperating with each other to form strong load-bearing studs interconnected by the stucco substrate and displaying on an interior side a configuration appearing as wall framing comprising studs of size and spacing customarily used in residential and commercial framing, and (b) a layer of stucco applied to said webs of said elongate load-bearing metal panels on the exterior sides of said metal lath stucco substrates, said stucco layer flowing, in part, inwardly through the openings in said metal lath stucco substrates.

17. The invention as claimed in claim 16, in which said metal lath stucco substrate is not present in the web portions closely adjacent said flanges, so that the web metal adjacent said flanges is solid and strong to aid in achievement of high strength studs.

18. The invention as claimed in claim 16, in which each said load-bearing metal panel and stucco substrate further comprises insulating foam disposed in said channels.

19. The invention as claimed in claim 18, in which said foam is foamed in said respective channels.

20. The invention as claimed in claim 19, in which rigid sheets are provided in said channels to confine said foam while it is foamed in said channels.

21. The invention as claimed in claim 20, in which said rigid sheets are cardboard, said cardboard remaining in place in said channels after manufacture of the metal panel and stucco substrates.

22. The invention as claimed in claim 19, in which said metal lath stucco substrate is not present in the web portions closely adjacent said flanges, so that the web metal adjacent said flanges is solid and strong to aid in achievement of high strength studs.

23. The invention as claimed in claim 18, in which said first and second stud portions are each channel shaped, in which said first stud portion nests snugly in the second stud portion of a said adjacent load-bearing metal panel and stucco substrate, and in which said second stud portion nests snugly over said first stud portion of an adjacent said load-bearing metal panel and stucco substrate.

24. The invention as claimed in claim 16, in which said first and second stud portions of each said metal panel and stucco substrate are each channel shaped, in which said first stud portion nests snugly in the second stud portion of an adjacent said load-bearing metal panel and stucco substrate, and in which said second stud portion nests snugly over said first stud portion of an adjacent said load-bearing metal panel and stucco substrate.

25. The invention as claimed in claim 16, in which each said load-bearing metal panel and stucco substrate is at least several times as long as it is wide.

26. The invention as claimed in claim 25, in which each said load-bearing metal panel and stucco substrate is at least five times as long as it is wide.

27. The invention as claimed in claim 16, in which the distance between the first and second stud portions of each said load-bearing metal panel and stucco substrate is about 16 inches center-to-center.

28. The invention as claimed in claim 27, in which each said load-bearing metal panel and stucco substrate is at least five times as long as it is wide.

29. The invention as claimed in claim 27, in which each said load-bearing metal panel and stucco substrate, when measured from the outside of the first flange to the outside of the second flange is about 16 inches wide.

30. The invention as claimed in claim 16, further comprising a connections in which a load-bearing metal panel and stucco substrate is connected to an adjacent metal panel and stucco substrate at a location adjacent the corners of each of the panels where the first and second flanges join the respective webs.

* * * * *